US006875124B2

(12) United States Patent
Gilbert et al.

(10) Patent No.: US 6,875,124 B2
(45) Date of Patent: Apr. 5, 2005

(54) GOLF CLUB IRON

(75) Inventors: Peter J. Gilbert, Carlsbad, CA (US); Michael Scott Burnett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 36 days.

(21) Appl. No.: 10/452,396

(22) Filed: Jun. 2, 2003

(65) Prior Publication Data

US 2004/0242339 A1 Dec. 2, 2004

(51) Int. Cl.[7] ..... A63B 53/04
(52) U.S. Cl. ..... 473/290; 473/342; 473/350
(58) Field of Search ..... 473/342, 344, 473/350, 290–291; D21/748, 733

(56) References Cited

U.S. PATENT DOCUMENTS

| | | | | |
|---|---|---|---|---|
| 4,027,885 | A * | 6/1977 | Rogers | 473/342 |
| 4,398,965 | A | 8/1983 | Campau | 148/3 |
| 4,645,207 | A * | 2/1987 | Teramoto et al. | 473/290 |
| 4,740,345 | A | 4/1988 | Nagasaki et al. | 264/257 |
| 4,798,383 | A | 1/1989 | Nagasaki et al. | 273/167 H |
| 4,883,275 | A * | 11/1989 | Boone | 473/334 |
| 4,884,812 | A * | 12/1989 | Nagasaki et al. | 473/342 |
| 5,121,918 | A * | 6/1992 | Teramoto et al. | 473/290 |
| 5,282,625 | A | 2/1994 | Schmidt et al. | 273/167 H |
| 5,544,885 | A | 8/1996 | Besnard et al. | 473/350 |
| 5,595,548 | A | 1/1997 | Beck | 473/324 |
| 5,605,511 | A | 2/1997 | Schmidt et al. | 473/324 |
| 5,643,112 | A | 7/1997 | Besnard et al. | 473/350 |
| 5,658,209 | A * | 8/1997 | Blakemore | 473/350 |
| 5,827,131 | A * | 10/1998 | Mahaffey et al. | 473/342 |
| 6,344,001 | B1 | 2/2002 | Hamada et al. | 473/329 |
| 6,440,010 | B1 | 8/2002 | Deshmukh | 473/335 |
| 6,688,989 | B2 * | 2/2004 | Best | 473/332 |
| 6,709,345 | B2 * | 3/2004 | Iwata et al. | 473/291 |
| 2002/0065140 | A1 | 5/2002 | Iwata et al. | 473/291 |
| 2002/0098910 | A1 | 7/2002 | Gilbert | 473/332 |
| 2003/0078112 | A1 * | 4/2003 | Sugimoto | 473/342 |
| 2003/0119602 | A1 * | 6/2003 | Kennedy et al. | 473/342 |

* cited by examiner

*Primary Examiner*—Stephen Blau
(74) *Attorney, Agent, or Firm*—D. Michael Burns

(57) ABSTRACT

An iron golf club head having a thin (less than 0.12 inches) first section that has an expanded unsupported front face region. The first section including a central portion forming part of a leading edge and wrapping around a sole section of the club, to create an increase the coefficient of restitution of the club head to greater than 0.8. The club head utilizes a rear insert that in addition to providing support for the front face, also allows for the fine tuning of swing weights with no change in geometry or size of the club head. This is accomplished this by the utilization of weight adjustment inserts that impregnate tungsten loaded plastic into sheets of carbon graphite and epoxy. The percentage of tungsten creating a weight range without any size change in the sheets.

30 Claims, 2 Drawing Sheets

GOLF CLUB IRON

FIELD OF THE INVENTION

The present invention relates to an improved iron golf club.

BACKGROUND OF THE INVENTION

The desire for perimeter weighting in a golf club iron is well known in the art. This desire stems from the fact that as the mass of the iron is distributed towards the perimeter, the trajectory of the hit ball becomes more accurate, despite off-center hits away from the sweet spot of the golf club face or hitting surface. Consequently, many modern golf club irons have a rear cavity that extends towards the rear side of the face surface of the iron. The weight saved by creating a rear cavity in the iron, is re-distributed to the perimeter of the golf club head. The greater the volume of the cavity, the greater the amount of mass of metal that can be redistributed to the perimeter of the golf club head. However, if the thickness of the face hitting surface is reduced to an extent where it becomes too thin, eventually a point is reached at which the strength of the face surface becomes too low to resist the force of the ball hitting the face.

Thus, it would be desirable to find a way to further increase the volume of the cavity without causing the face to fail upon impact with the ball. One way of achieving this increase in cavity volume is to increase the cross-section of the cavity as it approaches the rear of the front face or hitting surface of the club head, or in other words, create an undercut rear cavity perimeter. Unfortunately, such an undercut perimeter creates a trap area in which dirt and moisture can accumulate, which can otherwise create a surface integrity problem as a result of rust or otherwise detrimentally affect the aesthetics of the club head that can reduce its commercial success.

Other efforts are to provide a golf club head with light-weight fillers, composites, epoxy etc. to fill a part or all of the rear cavity. For example, some cavities can include a sheet of composite behind the face or the entire cavity can be filled with plastic.

As is well known in the golf club art, a typical set of golf club irons includes 8 or 9 irons (less for women, juniors and seniors) having variations in shaft length, weight, lie and loft among other parameters. By way of example, the iron having the lowest weight, longest shaft and the lowest loft is typically the number two iron and the club having the shortest shaft and the highest loft is typically called a wedge. It has been found that it is not necessarily appropriate for perimeter weighted clubs to have an equal distribution of weight in all irons of a set. More specifically, it has been found that in the longer, lower lofted clubs, such as the number 2 iron, number 3 iron, etc., may have the displaced cavity weight shifted towards the sole to increase the launch angle. It has also been found to be advantageous to have the weight distribution in the shorter clubs, such as the 8 iron, 9 iron and wedges shifted more towards the toe to decrease the launch angle. It has also been found advantageous to have little or no weight distribution shift in the middle irons, such as the 5 iron, 6 iron or 7 iron.

BRIEF SUMMARY OF THE INVENTION

The present invention creates an opportunity over the prior art by providing an iron club head designed to have a thin face with a bottom section of the thin face wrapped around and attached to the sole. The resulting effect creates an iron club head with a COR greater than 0.80.

One embodiment of the invention provides for a club head having a front face that includes a first section comprising at least 50 percent and more preferably greater than 60 percent of the front face. In the preferred embodiment, the thickness is generally uniform. The first section being relatively thin having a thickness ranging from about 0.06 inch to about 0.12 inch for long irons and becoming progressively thicker such that the first thickness for short irons is in the range of about 0.10 inch to about 0.16 inch. In a preferred embodiment, the thickness is generally uniform. The first section also has a center front edge that wraps around and is welded into the sole portion of the club. The combination of this feature, along with the thinning of the first section of the front face, provides a club head having an expanded front face region and can provide increase COR to the club head. This increase in the coefficient of restitution (COR) is especially useful in the long and mid-clubs.

An embodiment of the golf club head includes a perimeter weight defining a rear cavity therein. A composite insert comprised of a high specific gravity filler loaded plastic impregnated into a sheet of carbon graphite can be interposed within the rear cavity and attached to a back surface of the front face. The insert can provide support for the thin face, and allow for the fine-tuning of swing weights using the same basic club head model. The invention provides for inserts comprised of composite materials, and tungsten loaded plastic. The composites can vary the swing weight by the amount of tungsten impregnated into the composite sheet. Preferably, the composite is capable of a variance between 2 grams to 12 grams for a 2.25 $in^2$ and 0.02 to 0.025 inches thick sheet.

DETAILED DESCRIPTION OF THE INVENTION

Figure 1:
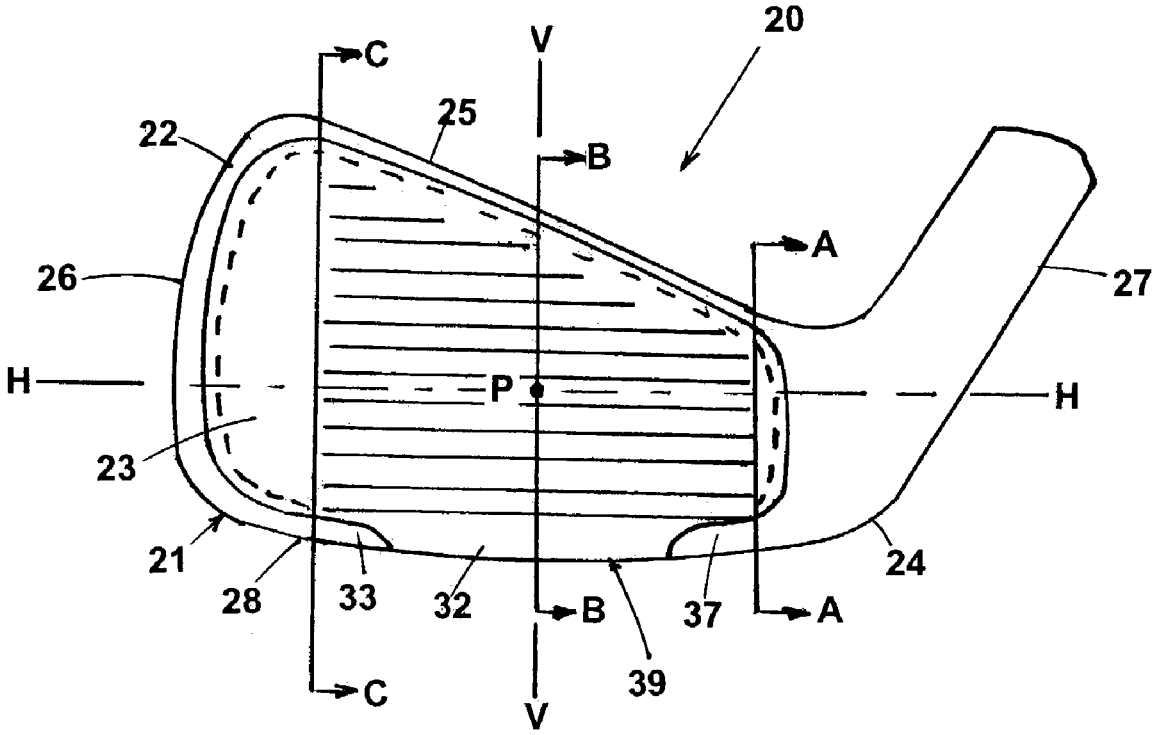
FIG. 1 is a front view of the golf club face.

Referring to FIGS. 1–5, an iron type golf club head 20 includes a body 21, a hosel 27 containing a cylindrical bore for receiving a golf club shaft (not shown), and a front face 22. The body 21 comprises a perimeter weight 38 that includes a heel section 24, and a toe section 26 that are spaced apart, and a top section 25 and a sole section 28 that are also spaced apart. The hosel 27 is connected to the heel section 24. The club head 20 is preferably cast or forged from suitable material such as stainless steel. The front face 22 arranged for impact with a golf ball (not shown) is provided on the body 21 and extends between the heel and toe portions 24, 26 along a front side of the body 21.

It is often desirable to create a golf club iron having a high moment of inertia (MOI) above the center of gravity CG.

The present invention accomplishes this by naturally positioning the center of gravity (CG on FIG. 4) low and towards the back of the club head 20 and pushing a substantial amount of mass to the perimeter weight 38. The center of gravity CG is toward the heel from centerline B—B of FIG. 1, and is behind the front face plane and below the horizontal plane that divides face in center (P). The MOI about the vertical axis (V) preferably ranges from 150 to 300 kg/mm$^2$, and more preferably from 200 to 300 kg/mm$^2$, while the MOI about the horizontal axis (H) preferably ranges from 45 to 60 kg/mm$^2$, and more preferably from 50 to 60 kg/mm$^2$. The weight removed from the front face 22 in order to create a thin face is about 5 to 30 grams. The invention includes the perimeter weight 38 protruding rearward from the front face 22 to define a rear cavity 31 in the back of the body 21.

A wider sole section 28, which is also positioned further rearward, creates a lower center of gravity CG in the club head 20. The repositioned center of gravity helps the flight of the ball obtain a higher trajectory because of the increased dynamic loft that yields a higher launch angle and greater sweet spot when compared to a conventional cavity back style golf club.

The present invention utilizes a thin front face 22. The unsupported club face region is also expanded to provide greater flexibility and thus greater ball speed due to the increased coefficient of restitution (COR). This is especially effective in mid-irons which are defined herein as a club that falls in between a loft of 16° to 40° and 16° to 30° for long irons.

Increased COR is accomplished by the creation of a thin face having a large area, preferably greater than 2.5 square inches and more preferably greater than 4 square inches, and then specifying the proper face material. The face thickness of the large area is preferably between about 0.06 inch to 0.12 inch. In an iron, where there is generally a small region that is unsupported by the back cavity perimeter walls, it becomes essential that the cavity contact region between the face and back is minimized and the perimeter walls pulled back, away from the club face. The club face of the present invention will provide for a COR greater than 0.79 and more preferably greater than 0.8.

The uniqueness of the present invention may be shown in the manufacturing process of the club head 20. The body 21 is cast or forged without a first section 23 of the front face 22. The body 21 is generally cast out of 431 stainless steel and substantially the entire front face 22 is made of rolled, stamped or forged high strength steel, preferably 455 stainless steel with a yield strength of 225,000 psi. The body 21 preferably has a yield strength of less than 150,000 psi. and more preferably less than 100,000 psi. while having an elongation greater than 10%. The front face preferably has a yield strength greater than 100,000 psi., and more preferably greater than 150,000 psi. with an elongation less than 15%. The lower yield strength and higher elongation (18% versus 12%) of 431 stainless steel over 17–4 stainless makes it a more desirable material for the body 21, so that the hosel can be bent for loft and lie adjustments. The first section 23 can be an insert or a front face plate.

Figure 2:
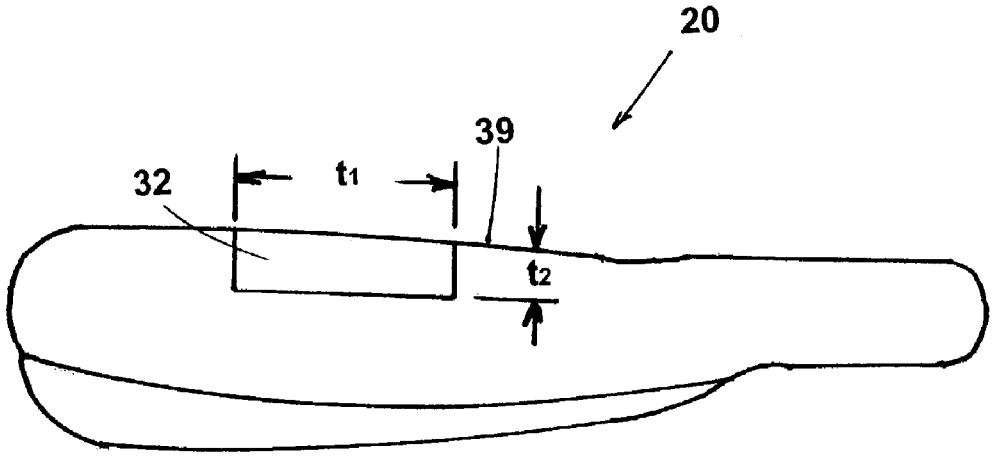
FIG. 2 is a bottom view of the sole depicting the center section.

FIGS. 1–2 show a first section 23 forming substantially the entire front face 22 (at least 50 percent) and having a first thickness t3 (FIG. 4) of about 0.06 inch to about 0.12 inch for the long irons (2–4 irons). This thickness can get progressively thicker as each club in the set of clubs becomes shorter, until the thickness of the short irons (9 and wedges) is about 0.10 inch to 0.16 inch. The first section 23 may comprise an insert or front plate that includes a central portion 32 of a leading edge 39 having a width t1 and a depth t2. The central portion 32 is situated between toe and heel portions 33 and 37. As cited above, the central portion 32 serves as a wrap-around piece for attachment by welding or other suitable means to the sole section 28, and forms a part of the leading edge 39. The width t1 of the central portion 32 is about 0.5 to 1.5 inches, and preferably about 1 inch. The depth t2 of the central portion 32 is about 0.30 to about 0.50 inch and preferably about 0.38 inch, although it could be more for long irons than short irons or it could be consistent throughout the set of clubs. The shape of the central portion 32, of the first section 23, moves a part of the face support rearwards, which expands face flexibility. First section 23 is precision cut or stamped to shape, and the leading edge is wrapped under. First section 23 is put into the open region on the body 21 and held in place by welding, adhesive bonding or brazing.

In contrast to the thin first section 23, the toe and heel portions 33 and 37, each preferably has a thickness of about 0.12 inch to 0.25 inch, and more preferably 0.185 inch at the heel portion Sth and at the toe portion Stt. The sole thickness, of either the heel section 37 or the toe section 33, is preferably at least twenty percent greater than the sole thickness (STc) of the central portion 32, and more preferably greater than twice the thickness.

Using high strength steel (445–465 stainless) on the first section 23 of the front face 22 allows the face to be thinned down and therein flex more. Typical face thickness on conventional irons range between about 0.12 inch and 0.18 inch. The face thickness for the present invention is preferably between about 0.04 inch and about 0.12 inch.

The thinnest of faces may be supported with a composite insert 34 comprising one or more layers of a light, flexible material like nylon, reinforced plastic or a carbon graphite composite sheet (plastic, RFP, nylon, carbon graphite, etc.). The composite insert 34 may be integrally designed to maximize COR, adjust feel, or provide reinforcement.

An embodiment of the invention utilizes a composite insert 34 comprising of a composite sheet of carbon graphite and epoxy 42, or plastic or other lightweight decorative plate that is mated with tungsten loaded plastic. The composite insert is inserted into rear cavity 31 and fastened to a back surface 30 of the front face 22 by adhesives or other suitable means. The composite insert 34 may function to dampen out unwanted vibrations, adjust weight or provide structural stability.

Sheets of tungsten-loaded plastic can be made to various density levels to create a range of insert weights while maintaining constant insert geometry and volume. One embodiment utilizes sheets wherein the sheet thickness of tungsten loaded plastic is varied to achieve a myriad of insert weights. Whatever the method, the composite insert 34 (carbon graphite sheet with tungsten loaded plastic) is primarily used as a means of adjusting the club head weight, and therefore the golf club's swing weight. The swing weight adjustment device can facilitate the manufacturing of various clubs that range in length and shaft options. The composite insert 34 is put into the club as a last operation to fine-tune the swing weight to an exact specification. The weight adjusting member can be sheet used in combination with a decorative and possibly structural, lightweight cover material.

Figure 3:
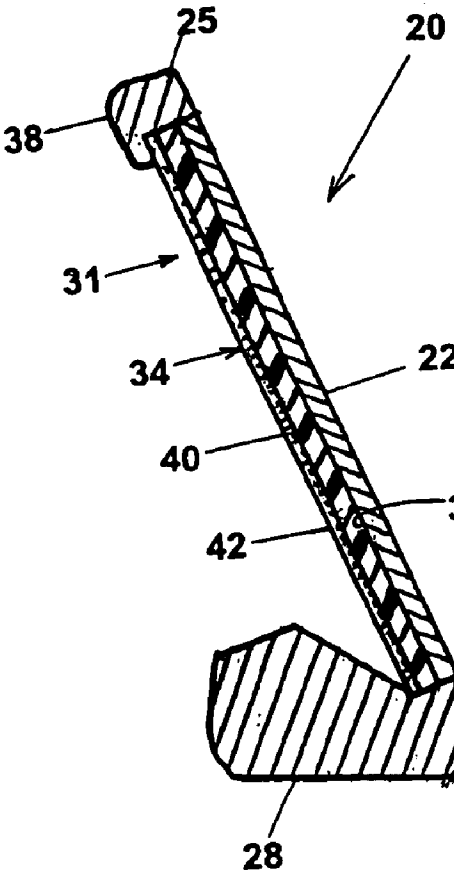
FIG. 3 is a heel cross-section view of the golf club head of the invention taken along lines C—C of FIG. 1.
Figure 4:
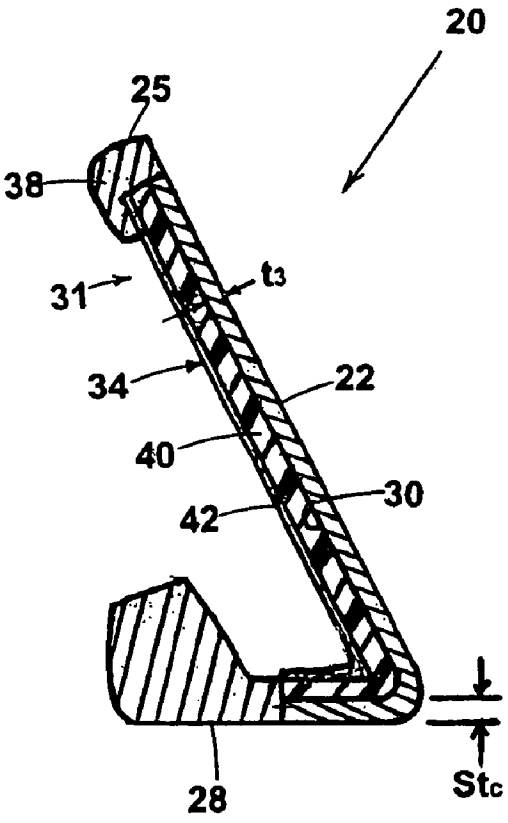
FIG. 4 is a cross-section view of the golf club head taken along lines B—B of FIG. 1.
Figure 5:
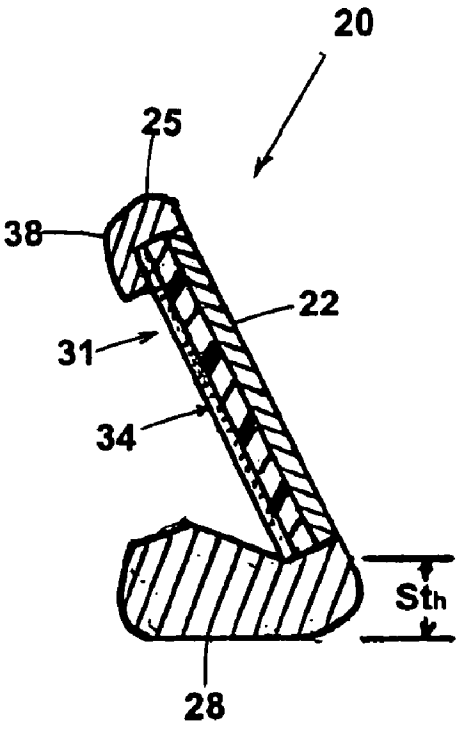
FIG. 5 is a toe cross-section view of the golf club head taken along lines A—A of FIG. 1.

FIG. 3 shows the composite insert 34 comprised of an extruded tungsten loaded plastic sheet 40, the front side of which is bonded to the back surface 30 of the front face 22, and a rear side bonded to a laminated composite sheet 42 of at least one layer. Tungsten could also be impregnated into the carbon graphite and epoxy sheet, or plastic cover sheet, which may carry art work, logo information, etc. The composite insert 34 may also be useful in damping vibration from impact with a golf ball, however it is important that the composite insert 34 have a high stiffness so as not to absorb energy to be provided by the club head 20. Typically, 1 $in^2$ to 4 $in^2$ of tungsten impregnated plastic sheet 40 will range from about 2 grams to about 24 grams. Ideally, the maximum thickness of the tungsten loaded plastic sheet 40 is about 0.01 inch to about 0.2 inch, preferably about 0.035 inch.

While it is apparent that the illustrative embodiments of the invention herein disclosed fulfills the objectives stated above, it will be appreciated that numerous modifications and other embodiments may be devised by those skilled in the art. Therefore, it will be appreciated that the appended claims are intended to cover all such modifications and embodiments which come within the scope of the claims.

It is claimed:

1. An iron golf club head comprising:

a body having a perimeter weight, a front face, and a leading edge:

the front face having a front insert forming a first section comprising at least 50 percent of the front face and a central portion of the leading edge, and having a first thickness;

the front face having a second section comprising a second thickness being greater than the first thickness;

the second section forming a heel portion and a toe portion of the leading edge; and the perimeter weight comprising a sole section, the central portion of the leading edge wrapping around and attaching to the sole section;

wherein the central portion has a width of about 0.5 inch to 1.5 inches, and a depth between about 0.30 inch to 1.0 inch.

2. The golf club of claim 1, wherein the first section has a thickness ranging from about 0.06 inch to about 0.12 inch.

3. The golf club of claim 1, wherein the insert has an area between 2.5 square inches and 4.0 square inches.

4. The golf club of claim 1, wherein the club head has a coefficient of restitution greater than 0.79.

5. The golf club of claim 1, wherein the first section has a substantially uniform thickness.

6. The club head of claim 1, wherein the first section is welded to the front face.

7. The club head of claim 1, wherein the first section is made from forged stainless steel.

8. The club head of claim 1, wherein the first section is made from stamped stainless steel.

9. The club head of claim 1, wherein the front face is made of high strength steel having a yield strength greater than 100,000 psi and an elongation less than about 15%.

10. The club head of claim 1, wherein the front face is made of titanium alloy having a yield strength between 100,000 psi and 150,000 psi.

11. The club head of claim 1, wherein the heel and toe portions each have a sole thickness that is at least twenty percent greater than the thickness of the first section.

12. The club head of claim 1, wherein the thickness of each of the heel and toe portions is about 0.12 inch to about 0.25 inch.

13. The golf club head of claim 1, wherein the perimeter weight surrounds a rear cavity, and a composite insert is interposed within the rear cavity and attached to a back surface of the front face.

14. The golf club head of claim 1, wherein the perimeter weight includes:

a rear cavity defined therein;

a composite insert comprising of a high specific gravity filler loaded plastic; and the composite interposed within the rear cavity and attached to a back surface of the front face.

15. An iron golf club head comprising:

a body having a perimeter weight, a front face comprising a front plate, and a leading edge:

the front plate forming at least 50 percent of the front face and a central portion of the leading edge, and having a first thickness;

the front face having a second section comprising a second thickness being greater than the first thickness;

the second section forming heel and toe portions of the leading edge; and the perimeter weight comprising a sole section, the central portion of the leading edge wrapping around and attaching to the sole section;

wherein the central portion has a width of about 0.5 inch to 1.5 inches, and a depth between about 0.30 inch to about 1.0 inch.

16. The golf club of claim 15, wherein the front plate has a thickness ranging from about 0.06 inch to about 0.12 inch.

17. The golf club of claim 15, wherein the front plate has an area between 2.5 square inches and 4.0 square inches.

18. The golf club of claim 15, wherein the club head has a coefficient of restitution greater than 0.79.

19. The golf club of claim 15, wherein the front plate has a substantially uniform thickness.

20. The club head of claim 15, wherein the front plate is welded to the front face.

21. The club head of claim 15, wherein the front plate is made from forged stainless steel.

22. The club head of claim 15, wherein the front plate is made from stamped stainless steel.

23. The club head of claim 15, wherein the front plate is made of high strength steel having a yield strength greater than 100,000 psi and an elongation less than about 15%.

24. The club head of claim 15, wherein the front plate is made of titanium alloy having a yield strength between 100,000 psi and 150,000 psi.

25. The club head of claim 15, wherein the heel and toe potions each have a sole thickness that is at least twenty percent greater than the front plate.

26. The club head of claim 15, wherein the thickness of each of the heel and toe portions is about 0.12 inch to about 0.25 inch.

27. The golf club head of claim 15, wherein the perimeter weight surrounds a rear cavity, and a composite insert is interposed within the rear cavity and attached to a back surface of the front face.

28. The golf club head of claim 15, wherein the perimeter weight includes:

a rear cavity defined therein;

a composite insert comprising of a high specific gravity filler loaded plastic; and the composite insert interposed within the rear cavity and attached to a back surface of the front face.

29. An iron golf club head comprising:

a body having a perimeter weight, a front face, and a leading edge:

the front face having a front insert forming a first section comprising at least 50 percent of the front face and a central portion of the leading edge, and having a first thickness;

the front face having a second section comprising a second thickness being greater than the first thickness; and the second section forming a heel portion and a toe portion of the leading edge, wherein the thickness of each of the heel and toe portions is about 0.12 inch to about 0.25 inch.

30. An iron golf club head comprising:

a body having a perimeter weight, a front face comprising a front plate, and a leading edge:

the front plate forming at least 50 percent of the front face and a central portion of the leading edge, and having a first thickness;

the front face having a second section comprising a second thickness being greater than the first thickness; and the second section forming heel and toe portions of the leading edge, wherein the thickness of each of the heel and toe portions is about 0.12 inch to about 0.25 inch.

* * * * *